US007302216B2

(12) United States Patent
Lior et al.

(10) Patent No.: US 7,302,216 B2
(45) Date of Patent: Nov. 27, 2007

(54) PRINT BLANKETS FOR USE IN ELECTRO-STATOGRAPHIC PRINTING AND METHODS OF USING SAME

(75) Inventors: Shai Lior, Rehovot (IL); Itzhak Ashkenazi, Kfar Gibton (IL); Mark Sandler, Rehovot (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 119 days.

(21) Appl. No.: 11/184,440

(22) Filed: Jul. 19, 2005

(65) Prior Publication Data

US 2007/0019997 A1 Jan. 25, 2007

(51) Int. Cl.
*G03G 15/16* (2006.01)
*G03G 15/01* (2006.01)

(52) U.S. Cl. ..... 399/308; 399/302

(58) Field of Classification Search ..... 399/237, 399/297, 302, 307, 308
See application file for complete search history.

(56) References Cited

U.S. PATENT DOCUMENTS 3,947,113 A * 3/1976 Buchan et al. ..... 399/308
5,585,905 A * 12/1996 Mammino et al. ..... 399/308
5,761,595 A * 6/1998 Tarnawskyj et al. ..... 399/308
6,479,205 B1 * 11/2002 Landa et al. ..... 399/308 X

* cited by examiner

*Primary Examiner*—Sandra L. Brase

(57) ABSTRACT

A print blanket for use in electrostatic printing, comprising a body portion; and, an image transfer layer comprising a non-silicone fluoroelastomer.

28 Claims, 5 Drawing Sheets

PRINT BLANKETS FOR USE IN ELECTRO-STATOGRAPHIC PRINTING AND METHODS OF USING SAME

FIELD OF THE INVENTION

The present invention relates to electro-statographic printing. For example, print blankets capable of use in electro-statographic printing are provided.

BACKGROUND OF THE INVENTION

In some electro-statographic printing techniques, the printing process begins with placing a uniform electrostatic charge on a photoreceptor and exposing the photoreceptor to a light and shadow image or to a scanning laser to dissipate the charge on the areas of the photoreceptor exposed to the light to form a latent electrostatic image. The resultant latent image is developed by subjecting the latent image to a liquid toner comprising a carrier liquid and colored toner particles. These toner particles are generally comprised of a pigmented polymer. Generally, the development is carried out, at least partially, in the presence of an electric field, such that the toner particles are attracted either to the charged or discharged areas, depending on the charge of the particles and the direction and magnitude of the field.

The developed image may then be transferred to a substrate such as paper or plastic film, often via an intermediate transfer member ("ITM") which is typically covered with a replaceable print blanket. The transferred image may then be permanently affixed to the substrate by the application of pressure, heat, solvent, overcoating treatment or other affixing processes. In general, in the commercial process used by HP-Indigo, the ITM is heated to a temperature that causes the toner particles and residual carrier liquid to form a film in the printed areas which film is transferred to the final substrate by heat and pressure. Fixing to the final substrate takes place as part of the transfer process.

The use of ITMs, and ITMs including transfer blankets, is well known. Multi-layered intermediate transfer print blankets for toner imaging are also known in the art. Generally, such blankets include a thin, multi-layered, silicone-based image transfer layer and a base (or body) portion which supports the image transfer layer and provides the print blanket with resilience during contact with an imaging surface and/or a final substrate. U.S. Pat. No. 5,745,829 to Gazit, et al. and U.S. Pat. No. 6,551,716 to Landa et al., the disclosures of which are incorporated herein by reference, describe print blankets for use with an ITM.

Other methods of manufacturing intermediate transfer members in the form of blankets and other types of blanket substrates are described, for example in U.S. Pat. No. 5,089,856 or U.S. Pat. No. 5,047,808, the disclosures of which are incorporated herein by reference.

In general, most ITM transfer surfaces are formed of a layer of silicone or a silicone rubber. For heated intermediate transfer members the surface should be abhesive to the hot toner material over repeated cycles of transfer to, heating on and transfer from the transfer surface. In general, silicone materials are superior to other materials in these properties and are used as transfer layers for ITMs for this purpose. Since various types of silicone materials are more or less abhesive to the hot toner (which is a hot melt adhesive) and have varying degrees of ruggedness, softness and other required mechanical properties, the choice of a material for transfer layers is a complex task.

A disadvantage of silicone layers, which is directly related to the liquid absorption, is a problem called "image memory". This problem is believed to be caused by uneven absorption of carrier liquid over the surface of the blanket. It is understood that the amount of carrier liquid that is absorbed at different portions of the surface depends on whether these portions have toner particles or not. If a next following color separation has a different distribution of toner, then the next image may, under some circumstances have varying values of gloss or even varying amounts of toner transfer depending on the amount of liquid absorbed from the previous layer.

Another disadvantage of silicone based image transfer layers pertains to their useful lifespan. Repetitive swelling and drying of the print blanket, and specifically the image transfer layer, often results in the degradation of the mechanical properties of the print blanket. Over time, this expansion and contraction of the print blanket, due to swelling, necessitates the replacement of the print blanket which can be time consuming and costly.

Nevertheless, despite the inherent problems associated with silicones as release layers, they are the release material of choice for liquid toner ITMs.

Fluorinated Teflon® and other similar materials have been used in offset printing blankets, see EP 0 629 514 which is incorporated herein by reference. However these materials are generally considered not suitable for liquid electro-statographic printing due in part to manufacturing considerations and the resultant properties of the Teflon® based blanket after manufacture. For example, in the thickness that fluorinated Teflon® can be reliably and continuously laid down during manufacture, the overall blanket is too hard for suitable use in liquid electro-statographic printing.

SUMMARY OF THE INVENTION

An aspect of some exemplary embodiments of the invention relates to providing a print blanket for use in an intermediate transfer member, for improving electro-statographic printing. Although the invention is described with respect to the best mode thereof, namely as a printing blanket mounted on a drum, the invention is also applicable to coated drum type intermediate transfer members.

In some exemplary embodiments of the invention, a transfer layer of the print blanket comprises at least a fluoroelastomer non-silicone material. Optionally, the fluoroelastomer material is a dipolymer of VF2/HFP. Optionally, the fluoroelastomer material is a terpolymer of VF2/HFP/TFE. Optionally, the fluoroelastomer material is a copolymer of TFE/Propylene and ethylene/TFE/PMVE. Optionally, the fluoroelastomer is a combination of any of the above.

In some exemplary embodiments of the invention, the transfer layer exhibits a hardness of no more than 65 Shore A. Optionally, the transfer layer exhibits a hardness of no more than 45 Shore A. Optionally, the transfer layer exhibits a hardness of between 25 and 35 Shore A. These low hardness values allow the layer to be thick enough to provide a continuous robust surface while at the same time allowing conformance with the surface of the photoreceptor/image/final substrate during transfer to and from transfer of the image to and from the ITM.

In some exemplary embodiments of the invention, the transfer layer exhibits an RMS surface roughness of no more than 700 Å or 500 Å. Optionally, the transfer layer exhibits an RMS surface roughness of no more than 250 Å or 150 Å.

Optionally, the transfer layer exhibits an RMS surface roughness of no more than 50 Å. The reason that this is desirable will become evident.

An aspect of some exemplary embodiments of the invention relates to providing a print blanket an increased lifespan. In some exemplary embodiments of the invention, the life span of the print blanket is increased by reducing its swelling during printing. It is noted that silicone materials solvate large amounts of carrier liquid when the toner is heated on the hot ITM. The inventors have found that use of an image transfer layer that does not react with and does not solvate the carrier liquid has unexpected advantages. For example, a standard transfer layer as used in HP Indigo® printers absorbs 150% (by weight) of Isopar® L from the carrier liquid, the materials useful in the present invention absorb no more than 10%, no more than 7.5% or no more than 3.5% by weight of the same carrier liquid at 90° C. In some exemplary embodiments of the invention, swelling reduction maintains the mechanical properties of the print blanket. Surprisingly, it is believed to provide an improved mechanism for transfer from the intermediate transfer member to the final substrate.

The present inventors have discovered that when heated toners that absorb carrier liquid, such as the HP-Indigo inks, undergo a phase change at the ITM temperature, some carrier liquid is expelled from the toner particles. For the silicone or silicone rubber blankets this liquid (whose production is higher on the hot ITM side of the toner layer) is absorbed by the release layer, bringing the hot toner, which is a hot melt adhesive, into intimate contact with the release layer. This is believed to be the reason why the hot release properties of silicone are so important for successful transfer of the image from the ITM.

When the materials of the present invention are used, absorption by the blanket is very low so that a thin layer of carrier liquid is formed between the toner material and the image transfer layer. This reduces the requirements for hot release. When the image transfer layer is very smooth, there are no portions of the image transfer layer that stick through the layer of liquid and the layer of liquid that forms naturally, on heating of the image, facilitates the transfer of the image from the transfer member.

It is noted that most materials that have suitable durability, hardness and smoothness to be used in the formulation of an image transfer layer absorb the carrier liquid to a degree which obviates this mechanism.

An aspect of some exemplary embodiments of the invention relates to providing a print blanket which facilitates manufacture. In an exemplary embodiment of the invention, producing a fluoroelastomer layer as a roll and laminating the layer on top of the blanket in a continuous process reduces the cleanliness requirements of the manufacturing environment. In some exemplary embodiments of the invention, there is no need to cut blankets for curing due to the unitary and continuous blanket body construction.

There is thus provided in accordance with an exemplary embodiment of the invention, an intermediate transfer member (ITM) for use in electrostatic printing, comprising: a body portion; and, an image transfer layer comprising a non-silicone fluoroelastomer. Optionally, the fluoroelastomer is a dipolymer of VF2/HFP. Optionally, the fluoroelastomer is a terpolymer of VF2/HFP/TFE. Optionally, the fluoroelastomer is a copolymer of TFE/Propylene and ethylene/TFE/PMVE. In some exemplary embodiments of the invention, the image transfer layer exhibits a Shore A hardness of no more than 65 at room temperature. Optionally, the image transfer layer exhibits a Shore A hardness of no more than 45 at room temperature. Optionally, the image transfer layer exhibits a Shore A hardness of between 25 and 35 at room temperature. In some exemplary embodiments of the invention, the image transfer layer exhibits an RMS surface roughness of no more than 700 Å. Optionally, the image transfer layer exhibits an RMS surface roughness of no more than 500 Å. Optionally, the image transfer layer exhibits an RMS surface roughness of no more than 150 Å. Optionally, the image transfer layer exhibits an RMS surface roughness of between 40-50 Å. In some exemplary embodiments of the invention, the image transfer layer is comprised of no more than 80% fluoroelastomer. Optionally, the image transfer layer is comprised of no more than 71% fluoroelastomer. Optionally, the image transfer layer is comprised of no more than 65% fluoroelastomer. In some exemplary embodiments of the invention, the body and said image transfer layer are in the form of a blanket for attachment to a printing drum. Optionally, the ITM further comprises a fixture operative to attach said blanket to a drum. Optionally, the image transfer layer is conductive. Optionally, the ITM further comprises a hard under layer.

There is thus provided in accordance with an exemplary embodiment of the invention, a method of printing, comprising: forming a liquid toner image comprising a pigment toner and a hydrocarbon liquid on an image surface; first transferring said image to an intermediate transfer member, wherein said intermediate transfer member comprises a release layer comprising a non-silicone fluoroelastomer; then transferring of said image from said intermediate transfer member to a final substrate; and, affixing said image on said final substrate. Optionally, the method further comprises heating said intermediate transfer member prior to transferring said image thereto. In some exemplary embodiments of the invention, the heating is to a range between 85° C. and 200° C. In some exemplary embodiments of the invention, the fluoroelastomer based image transfer layer absorbs no more than 10% of said carrier liquid. Optionally, the fluoroelastomer based image transfer layer absorbs no more than 7.5% of said carrier liquid. Optionally, the fluoroelastomer based image transfer layer absorbs no more than 3.5% of said carrier liquid. In some exemplary embodiments of the invention, the image surface is a photoreceptor.

There is thus provided in accordance with an exemplary embodiment of the invention, a method of printing, comprising: forming a liquid toner image comprising pigmented polymer toner particles and a hydrocarbon liquid on an image surface; first transferring said image to an intermediate transfer member, wherein said intermediate transfer member comprises a release layer that absorbs less than 10% of its weight of the hydrocarbon liquid from said transferred image; then transferring of said image from said intermediate transfer member to a final substrate; and, affixing said image on said final substrate. In some exemplary embodiments of the invention, the method further comprises heating said intermediate transfer member prior to transferring said image thereto. In some exemplary embodiments of the invention, the heating is to a range between 85° C. and 200° C. In some exemplary embodiments of the invention, the fluoroelastomer based image transfer layer absorbs no more than 7.5% of said carrier liquid. Optionally, the fluoroelastomer based image transfer layer absorbs no more than 3.5% of said carrier liquid.

BRIEF DESCRIPTION OF THE DRAWINGS

Exemplary non-limiting embodiments of the invention are described in the following description, read with reference to the figures attached hereto. In the figures, identical and similar structures, elements or parts thereof that appear in more than one figure are generally labeled with the same or similar references in the figures in which they appear. Dimensions of components and features shown in the figures are chosen primarily for convenience and clarity of presentation and are not necessarily to scale. The attached figures are.

DESCRIPTION OF EXEMPLARY EMBODIMENTS

Exemplary Print Blanket Embodiments

Figure 1A:
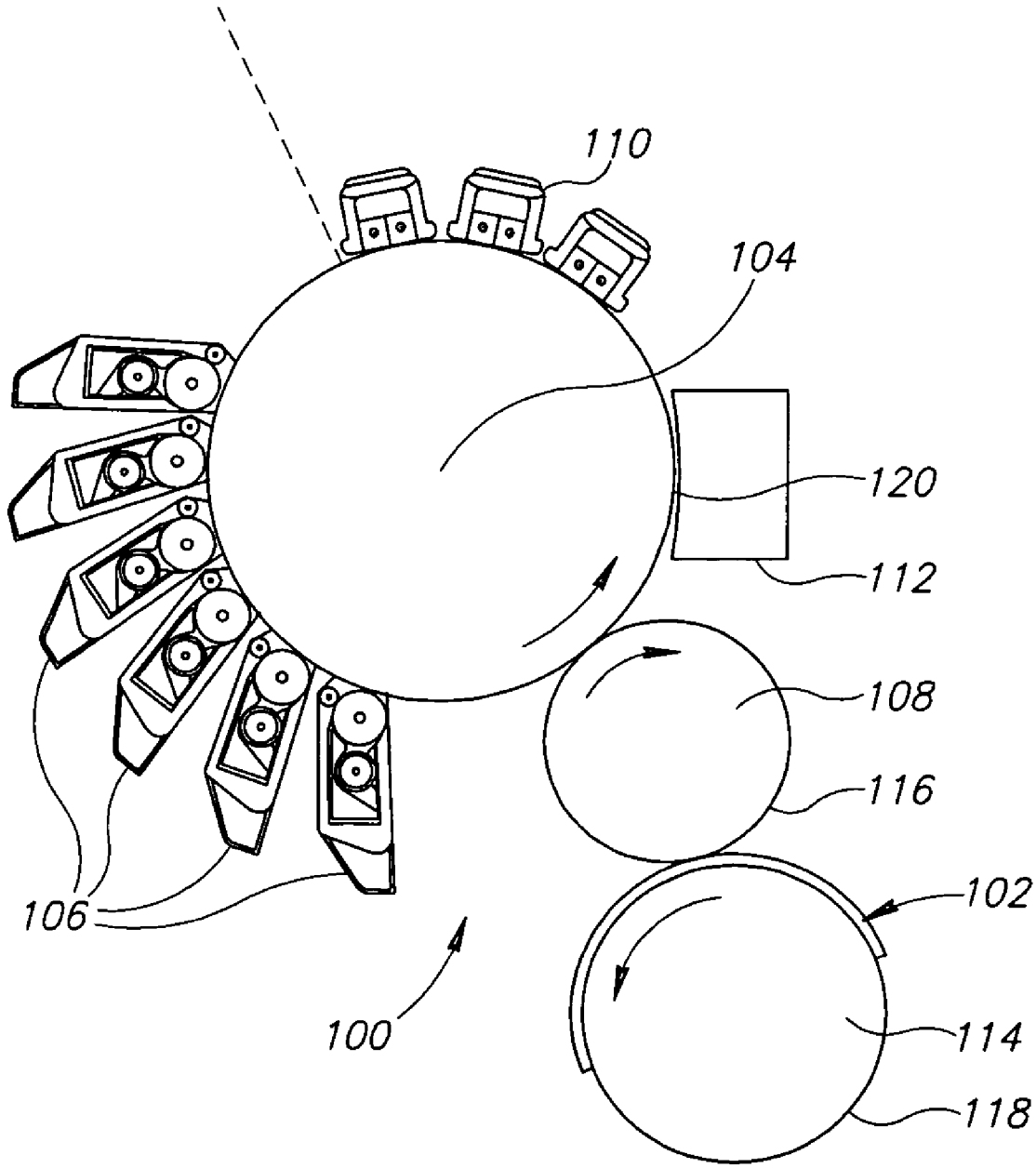
FIG. 1A is a simplified schematic diagram showing the relative positions of components of a print engine, in accordance with an exemplary embodiment of the invention.

Referring to FIG. 1A, a basic representation of a print engine 100 is shown, in accordance with an exemplary embodiment of the invention. In an exemplary electrostatographic printing process, a photo imaging plate ("PIP") 104 or photoreceptor is given a uniform charge by at least one charge unit 110. This uniform charge is selectively discharged to form a latent electrostatic image by, for example a light beam shown as a dashed line, which cans across the PIP as it rotates in the direction shown. The selective discharging on the PIP forms a latent image that corresponds to an image which is to be printed by print engine 100. Liquid toner is optionally discharged from at least one binary image developer ("BID") 106 which adheres to the appropriately charged areas of PIP 104, thereby developing the latent image. In some exemplary embodiments of the invention, the liquid toner is comprised of at least pigmented toner particles (comprising a polymer and a pigment) and a hydrocarbon liquid. The developed image is first transferred to an ITM 108 and heated on the ITM. The developed image is then transferred, in a second transfer, to a final substrate 102 as described below. U.S. Pat. No. 5,596,396 to Landa et al. and U.S. Pat. No. 5,610,694, to Lior et al., the disclosures of which are herein incorporated by reference, describe methods and apparatuses for binary image development.

PIP 104 is optionally discharged and cleaned by a cleaning/discharging unit 112 prior to recharging of PIP 104 in order to start another printing cycle. As substrate 102 passes by ITM 108, the image located on ITM 108 surface 116 is then transferred and affixed to substrate 102. Affixation of the image to substrate 102 is facilitated by locating substrate 102 on the surface 118 of impression roller 114, which applies pressure to substrate 102 by compressing it between impression roller 114 and ITM 108 as the image is being transferred to substrate 102. Eventually, substrate 102 bearing the image exits the printer. In some exemplary embodiments of the invention, the printer is a sheet-fed printer. Optionally, the printer is a web-fed printer.

FIG. 1A also shows a plurality of BID units 106 located in image development area 100. In some exemplary embodiments of the invention, each BID contains a different color toner, for use in producing multi-color images. Optionally, BID units are not used for depositing toner on PIP 104 and other development methods and/or other image formation methods, as known in the art, are used. It should be understood that the foregoing print engine description is provided by way of example only, and that print blankets described herein are suitable for use with a variety of liquid toner print engines.

Figure 1B:
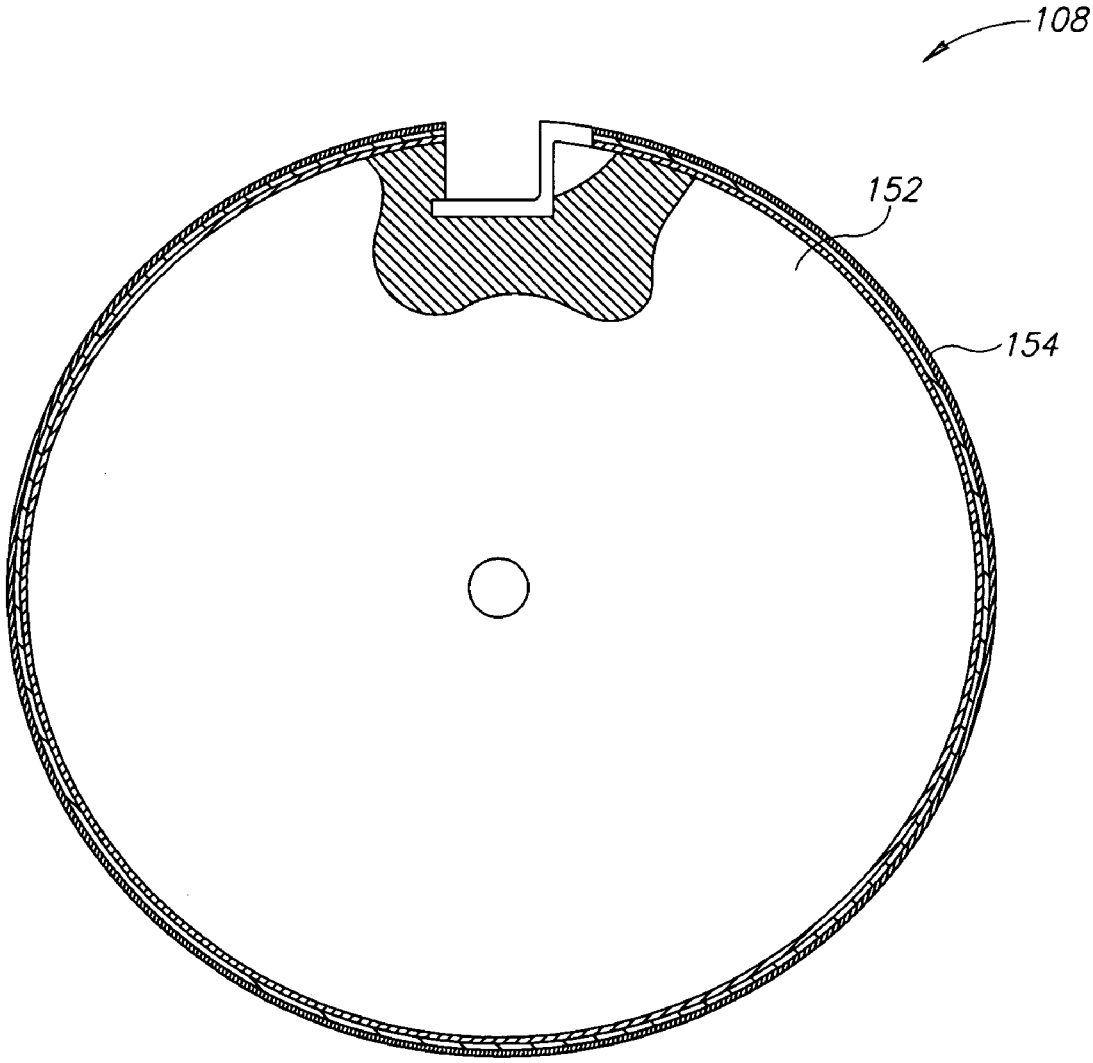
FIG. 1B is a simplified cross-sectional illustration of an ITM, including a multi-layered print blanket mounted on a drum, in accordance with an exemplary embodiment of the present invention.

Reference is now made to FIG. 1B which is a simplified cross-sectional illustration of ITM 108, including a multi-layered print blanket 154 mounted on a drum 152, in accordance with an exemplary embodiment of the present invention. As is known in the art, ITM 108 is maintained at a suitable voltage and temperature (optionally between 85° C.-200° C.) for electrostatic transfer of a toner image thereto from an image-bearing surface, such as a photoreceptor surface. The image is preferably transferred from ITM 108 onto a final substrate 102, such as paper, optionally by heat and pressure.

Reference is now made to FIGS. 2A to 2F which schematically illustrate exemplary embodiments of print blankets, in accordance with various embodiments of the invention.

Figure 2A:
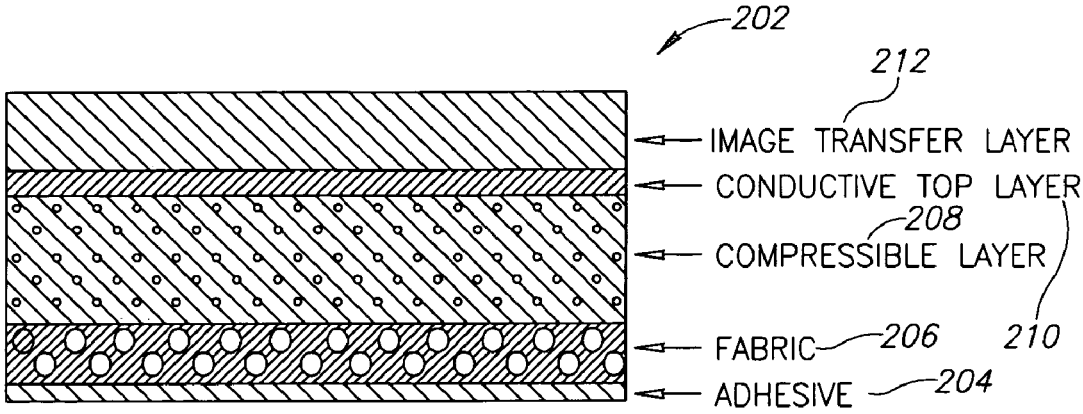
FIGS. 2A-F are cross-sectional views of different print blanket configurations, in accordance with exemplary embodiments of the invention; and, FIG. 3 is a cross-sectional view of liquid toner coating an image transfer layer of a print blanket, in accordance with exemplary embodiments of the invention

FIG. 2A illustrates an exemplary embodiment of a print blanket 202 in which no underlayer 216, described below, is provided. In an exemplary embodiment of the invention, an adhesive 204 is optionally used to secure print blanket 202 to drum 152. Optionally, only a portion of print blanket 202 is secured to drum 152 by adhesive. In an exemplary embodiment of the invention, adhesive 204 is the innermost layer of print blanket 202 in relation to drum 152. Optionally, print blanket 202 is mechanically secured to drum 152, for example using the apparatuses and methods described in U.S. Pat. No. 6,551,716 to Landa et al., the disclosure of which is incorporated herein by reference. Optionally, the leading edge of print blanket 202 is held in place by a fixture, such as described in U.S. Pat. Nos. 5,745,829 and 6,551,716. In some embodiments of the invention, if the back surface of the next layer is very smooth and soft enough so that the blanket clings to the drum beneath, no adhesive is necessary, (or the adhesive layer is replaced by a very smooth, soft layer).

In the exemplary embodiment of the invention depicted in FIG. 2A, adhesive 204 (if present) is covered by a reinforced rubber impregnated fabric layer 206 as known in the art. This layer is similar to a corresponding layer in offset printing blankets. The next outermost layer, in accordance with an exemplary embodiment of the invention, is a compressible layer 208. This layer, which may comprise multiple layers of compressible material, is described in detail in PCT publication WO 97/07433, the disclosure of which is incorporated herein by reference. A conductive layer 210 is provided externally of compressible layer 208 from drum 152, in some exemplary embodiments of the invention. This allows for the application of a voltage between the blanket and a photoreceptor from which the image is to be transferred to aid in transferring the image to the photoreceptor.

Figure 2B:
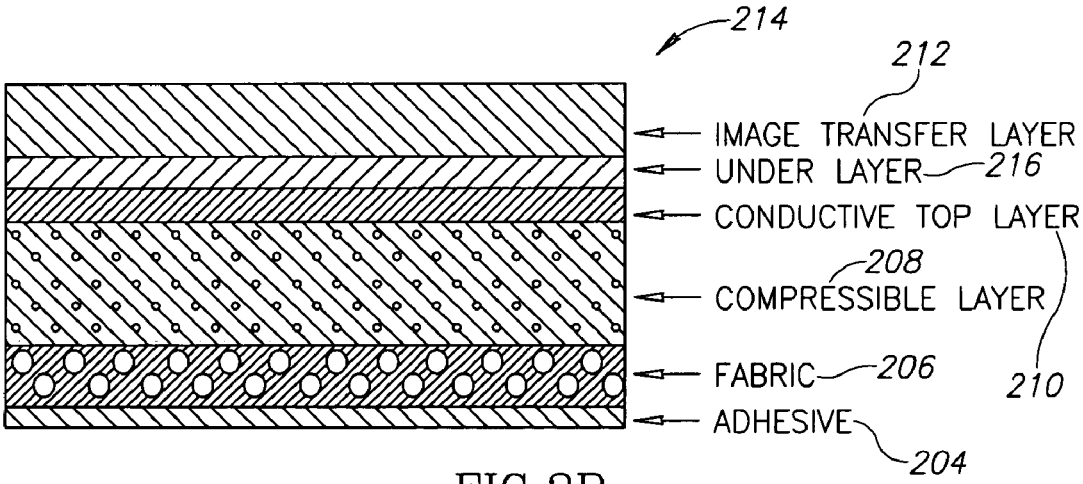

Layers 206-210 are optionally considered the "body" of print blanket 202. Optionally, the body of the print blanket includes an underlayer 216 (FIG. 2B).

Certain aspects of the present invention, especially the composition of the portion of the print blanket situated below the image transfer layer, are shown and described by way of example only and may vary in accordance with specific requirements and design considerations.

It should be understood that the above construction of the blanket body can be purely conventional and does not, by itself, differ substantially from prior art blankets for use in electrostatographic printing. For example the material properties (such as hardness), and/or the materials used and/or the thicknesses of the layers may be similar to those used in the prior art including the references incorporated herein. A major innovation in the blankets described herein is in the image transfer layer as described below. Further, the image transfer layer can be used with any heated intermediate transfer member for liquid toner images.

In an exemplary embodiment of the invention, the outermost layer of print blanket 202 in relation to drum 152 is an image transfer (upper) layer 212. In FIG. 2A, image transfer layer 212 is positioned on conductive layer 210 such that in operation, an image can be transferred to the image transfer layer from an image-bearing surface, such as a photoreceptor surface, and then transferred to a final substrate, such as paper or plastic film.

In an exemplary embodiment of the invention, image transfer layer 212 is comprised of a fluoroelastomer. Optionally, the fluoroelastomer material is a dipolymer of VF2/HFP. Optionally, the fluoroelastomer material is a terpolymer of VF2/HFP/TFE. Optionally, the fluoroelastomer material is a copolymer of TFE/Propylene and ethylene/TFE/PMVE. Optionally, the fluoroelastomer is a combination of any of the above. Commercially available fluoroelastomer products suitable for use with image transfer layer 212 include the Viton® family of fluoroelastomers by DuPont®, Kalrez®, the Dyneon® family by 3M® and the Technoflon® family by Solvay or FKM. Additives known in the art are optionally added to image transfer layer 212 for properties optimization. For example, carbon black and/or salts are added to optimize the conductivity of the transfer layer by choosing the proper concentration and particle size. Additives like Teflon, silicone and/or others allow optimization of release properties. In some exemplary embodiments of the invention, the elastomer formulation is comprised of no more than 80% fluorine by weight. Optionally, the elastomer formulation is comprised of no more than 71% fluorine by weight. Optionally, the elastomer formulation is comprised of no more than 65% fluorine by weight.

The inventors have found that the layer should be softer than Shore A 50-60, although softer materials such as Shore A of 40-50 is desirable. Mixtures of different fluoroelastomer elastomer materials may be used to provide a desired softness of the layer.

Figure 2C:
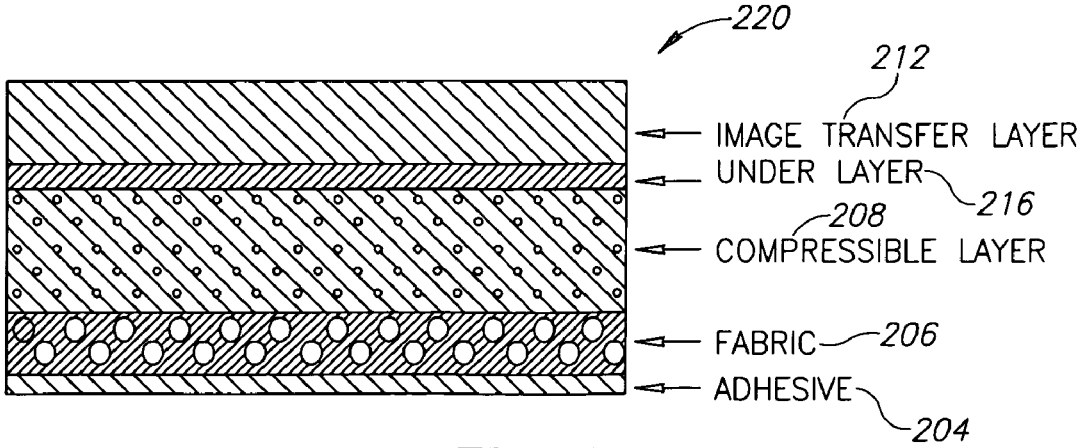

Reference is made to FIG. 2C, where in accordance with an exemplary embodiment of the invention, no conductive layer is provided to a print blanket 220. As described below, with respect to FIG. 2E, it has been found that a fluoroelastomer layer such as described herein can be made conductive enough to replace a conventional conductive layer.

Figure 2D:
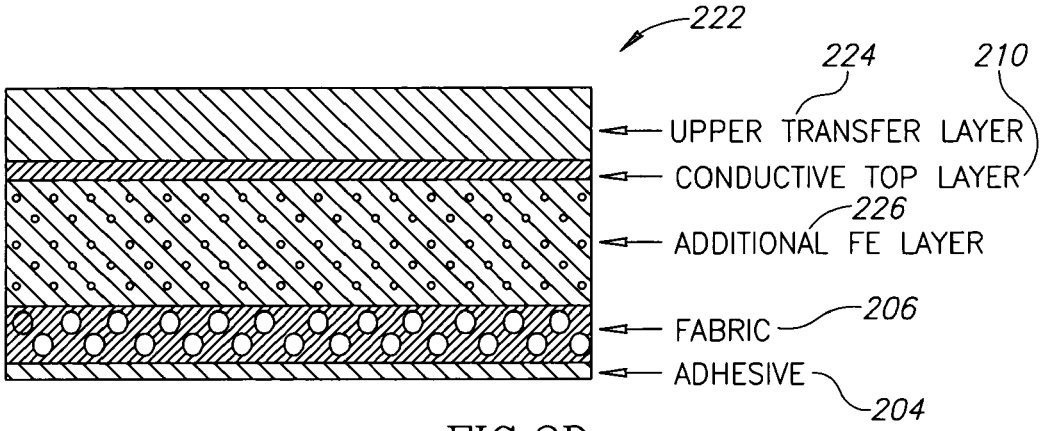

A blanket 222 is shown in FIG. 2D, wherein compressible layer 208 of other embodiments of the invention is replaced by an additional fluoroelastomer layer 226. Blanket 222 thus is provided with two fluoroelastomer layers, an upper, transfer layer 224 and additional layer 226. In some exemplary embodiments of the invention, additional layer 226 is adapted to provide the same functionality as compressible layer 206 found in other exemplary blanket embodiments. Additional layer 226 is comprised of sufficient thickness to provide reliable and/or high quality transfer of an image to a final substrate. Optionally, additional layer 226 is no more than 200 microns thick. Optionally, additional layer is no more than 500 microns thick. In some exemplary embodiments, additional layer 226 is more than 500 microns thick. In some exemplary embodiments of the invention, manufacturing costs are saved by eliminating the need for an additional component material (spongy compression layer).

Figure 2E:
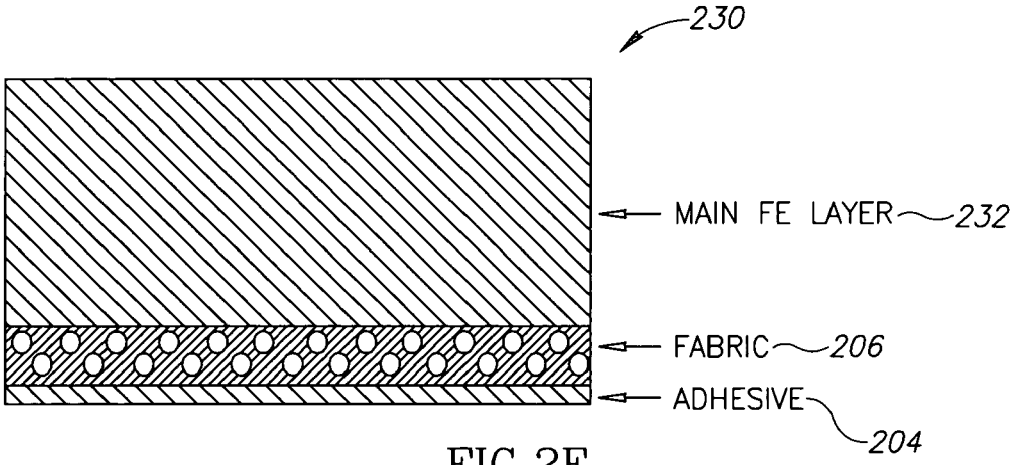
Figure 2F:
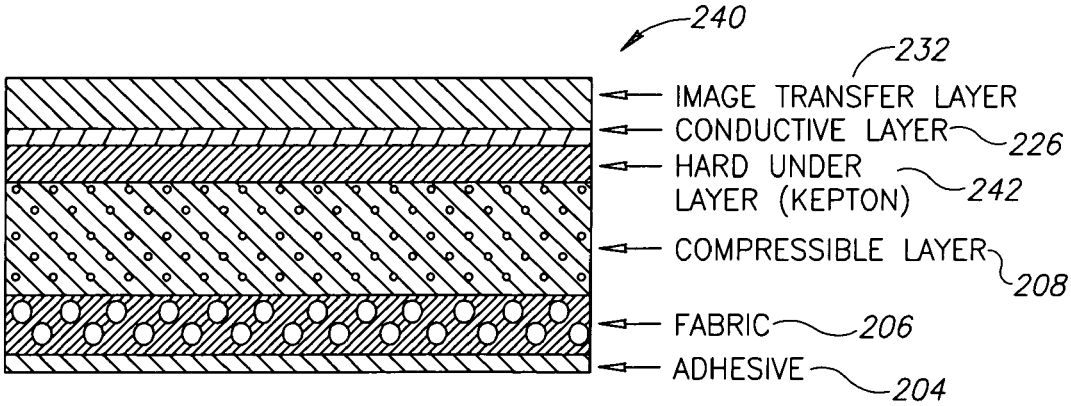

Referring to FIG. 2E, an exemplary blanket 230 is shown wherein a main fluoroelastomer layer 232 is used in lieu of image transfer layer 212, conductive layer 210, under layer 216, and/or compressible layer 208. Main fluoroelastomer layer 232 is adapted to perform a variety of functions, in an exemplary embodiment of the invention. For example, main fluoroelastomer layer 232, it has been shown by the inventors, exhibits sufficient electrical conductivity to act in lieu of conductive layer 210. Optionally, additives such as carbon black and/or salts are included in main fluoroelastomer layer 232 to enhance conductivity of layer 232. Optionally, the portion of the main FE layer further from a surface of main FE layer exhibits enhanced conductivity relative to the portion of main FE layer closer to the surface. Additionally, it has been found by inventors that main fluoroelastomer layer 232 exhibits sufficient micro and macro hardness to provide reliable and/or high quality first (from PIP) and second transfer (to final substrate) of an image. In some exemplary embodiments of the invention, main fluoroelastomer layer 232 is no more than 100 microns thick. Optionally, main fluoroelastomer layer 232 is no more than 500 microns thick. In some exemplary embodiments of the invention, main fluoroelastomer layer 232 is more than 500 microns thick FIG. 2F shown an exemplary blanket 240 wherein a hard under layer 242 is provided. In an exemplary embodiment of the invention, hard under layer 242 is provided to enhance application of blanket 240 pressure during image transfers. In an exemplary embodiment of the invention, hard under layer 242 is comprised of Kepton®. In some exemplary embodiments of the invention, hard under layer 242 is no more than 200 microns thick. Optionally, hard under layer 242 is no more than 100 microns thick. In some exemplary embodiments of the invention, hard under layer 242 is between 5-25 microns thick.

Improvement of Image Quality

Silicone based image transfer layers, as are known in the art, swell when used in conjunction with a liquid toner. Mineral oils and other liquid components of liquid toner are absorbed by the silicone based image transfer layers. As a result, image quality can be degraded when the image is finally transferred from the ITM to the final substrate. This image quality degradation manifests itself in a plurality of ways. The first is that when a print blanket swells, its surface begins to vary in glossiness. Most images do not require 100% toner coverage. For example, there are spaces in between words, letters, and paragraphs in a printed document and spaces between dots in a half-tone image. These spaces do not require the placement of toner on the image transfer layer in order to manifest themselves on a final substrate. In those areas where toner is not transferred to the image transfer layer, there is little if any swelling, whereas where there is liquid toner present, swelling occurs. This disparity in swelling results in a visible differential in gloss in the toner and non-toner areas of the final substrate for subsequent images. That is, those areas where swelling occurred before transfer of the present image exhibit a different glossiness than those areas which remained liquid toner free in the previous image. Differential gloss on the final substrate is often considered a degradation of the image. Use of a fluorinated elastomer in the image transfer layer of a print blanket reduces the swelling of the print blanket in the presence of liquid toner. As a result, differential gloss is reduced and image quality is improved.

In an exemplary embodiment of the invention, electrostatic printing is conducted using an image transfer layer with less favorable release properties to hot melt adhesives, such as liquid toner, in the operational range of 85° C.-200° C., than the silicone materials normally used. In addition, it is also noted that at the operation temperature of 85° C.-200° C., fluoroelastomer based image transfer layers in print blankets decrease in material hardness, thus enabling the image transfer layer to better conform to the substrate surface topography and transfer a more true image. In some exemplary embodiments of the invention, the image transfer layer exhibits a Shore A hardness of no more than 65 at room temperature. Optionally, the image transfer layer exhibits a Shore A hardness of no more than 45 at room temperature. Optionally, the image transfer layer exhibits a Shore A hardness of between 25 and 35 at room temperature. In an exemplary embodiment of the invention, the hardness of the fluoroelastomer layer decreases with increasing temperature to 110-150° C. by 10-15 Shore A. In such an embodiment, hardness measurements of 65 Shore A material at room temperature show 45-50 Shore A at this temperature.

Figure 3:
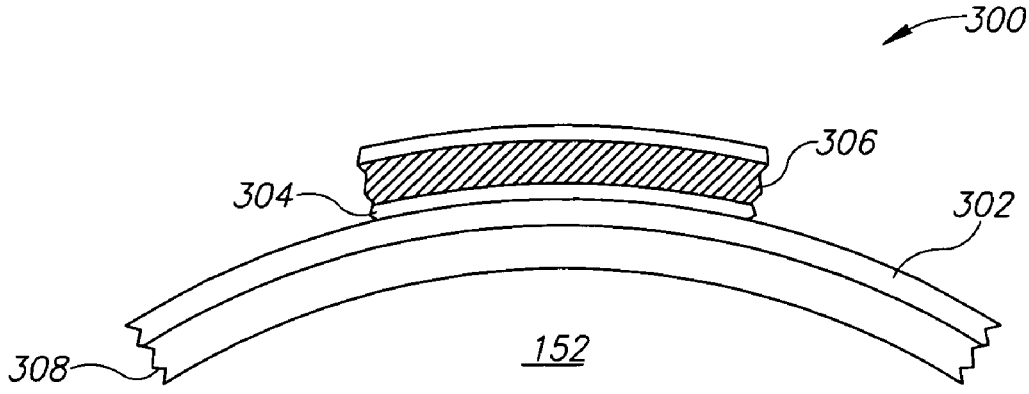

Image quality is also improved, in some exemplary embodiments of the invention, by using a fluorinated elastomer based image transfer layer to maintain a liquid layer between the transfer layer and the heated toner particles in the liquid toner formulation. Referring to FIG. 3, a cross-sectional view of liquid toner 300 coating an image transfer layer 302 of a print blanket 308 is shown. In conventional electrostatic printing, drum 152 is typically heated by an internal halogen lamp heater or other heater to aid transfer of the image to the image transfer layer 302 and therefrom to the final substrate, as is well known in the art. As is described above, operational temperatures for the heated ITM are often in the range of 85° C.-200° C. It should be noted, however, that the degree of heating often depends on the characteristics of the toner and/or ink used.

The high temperature of the ITM causes the toner particles of the liquid toner formulation to become heated and subsequently to fuse. In the regions of the liquid toner closer to the ITM, a layer of liquid 304 is created which is typically comprised of carrier liquid and oils associated with the liquid toner formulation. Due to the high temperatures, the carrier liquid associated with the liquid toner are prone to evaporation. When silicone materials are used for the transfer layer, the portion of the liquid layer 304 which isn't evaporated by heat is absorbed by the image transfer layer. This causes a hot melt adhesive layer 306 of the liquid toner to come into direct contact with image transfer layer 302. This contact may result in some portion of hot melt adhesive layer 306 sticking to image transfer layer 302 and not transferring to the final substrate. This sticking results in degraded image quality since some of the image remains on image transfer layer 302. This also requires that the transfer layer be abhesive to the hot melt adhesive polymer that is the basis for the toner. This results in the requirement that the coating be abhesive to the hot melt adhesive toner, a difficult condition to achieve and even more difficult to maintain.

By using a carrier liquid resistant fluoroelastomer based image transfer layer, such as those described herein, absorption of the liquid layer 304 between hot melt adhesive layer 306 and image transfer layer 302 is diminished. This results in a substantially intact liquid layer 304 which acts as a release facilitator acting when the image (which is now represented by hot melt adhesive layer 306) is transferred to the final substrate. Surface roughness of the image transfer layer plays a factor in the maintenance of liquid layer 304. For example, if the surface of image transfer layer 302 has high peaks and valleys, it is likely that liquid layer 304 will deposit itself into the valleys, leaving the peaks exposed to direct contact with hot melt adhesive layer 306. If the surface is smooth however, there is less of a chance of hot melt adhesive layer 306 contacting image transfer layer 302. Therefore in an exemplary embodiment of the invention, a print blanket is provided which has an image transfer layer with an RMS surface roughness of no more than 700 Å or 500 Å. Optionally, the image transfer layer has an RMS roughness of no more than 250 Å or 150 Å. Optionally, the image transfer layer has an RMS roughness of between 40 and 50 Å.

It should be especially noted that print blankets containing fluoroelastomer image transfer layers, such as those described herein, are advantageous over conventional silicone based print blankets because they do not have to be as abhesive since in normal operation fluids rarely penetrate to the body of the blanket.

Increased Lifespan

In an exemplary embodiment of the invention, print blanket life is increased by using a non-silicone fluoroelastomer based image transfer layer thereon. As described herein, conventional silicone based image transfer layers absorb liquids associated with liquid toner formulations. This absorption and subsequent evaporation of liquid causes a cycle of expansion and contraction in the image transfer layer which is both unremitting and quick in nature. As a result, the mechanical properties of silicon based image transfer layers degrade over time, necessitating frequent replacement of the print blanket. In addition to the complications, which arise as a result of the cycles of expansion and contraction, absorption of liquid by the image transfer layer reduces its strength and its resistance to damage.

Fluorine based image transfer layers, however, resist the absorption of carrier liquid from liquid toners. This resistance manifests itself in less expansion and contraction during the course of its lifetime. The result of less transfer image layer flexing is the increased retention of mechanical properties, including strength and damage resistance, and hence usable lifespan.

Exemplary Method of Manufacture

In an exemplary embodiment of the invention, an image transfer layer is formed on a smooth release coated sheet, Teflon sheet and/or metalized Mylar® sheet. Mylar® is optionally used due to its smoothness. In an exemplary embodiment of the invention, the face of the image transfer layer that is proximal to the Mylar® sheet is the face that is used on the outside of the print blanket. Meanwhile, the face of the image transfer layer that is away from the Mylar® sheet during manufacture is the face that is nearest the body of the print blanket when in operation. In an exemplary embodiment of the invention, producing a fluoroelastomer layer as a roll and laminating the layer on top of the blanket in a continuous process reduces the cleanliness requirements of the manufacturing environment. In some exemplary embodiments of the invention, there is no need to cut blankets for curing due to the unitary and continuous blanket body construction.

The present invention has been described using non-limiting detailed descriptions of embodiments thereof that are provided by way of example and are not intended to limit the scope of the invention. It should be understood that features and/or steps described with respect to one embodiment may be used with other embodiments and that not all embodiments of the invention have all of the features and/or steps shown in a particular figure or described with respect to one of the embodiments. Variations of embodiments described will occur to persons of the art. Furthermore, the terms "comprise," "include," "have" and their conjugates, shall mean, when used in the disclosure and/or claims, "including but not necessarily limited to."

It is noted that some of the above described embodiments may describe the best mode contemplated by the inventors and therefore may include structure, acts or details of structures and acts that may not be essential to the invention and which are described as examples. Structure and acts described herein are replaceable by equivalents, which perform the same function, even if the structure or acts are different, as known in the art. Therefore, the scope of the invention is limited only by the elements and limitations as used in the claims.

The invention claimed is:

1. An intermediate transfer member (ITM) for use in electrostatic printing, comprising:

a body portion; and, an image transfer layer comprising a non-silicone fluoroelastomer, wherein said fluoroelastomer is a copolymer of TFE/Propylene and ethylene/TFE/PMVE.

2. An ITM according to claim 1, wherein said image transfer layer exhibits a Shore A hardness of no more than 65 at room temperature.

3. An ITM according to claim 1, wherein said image transfer layer exhibits a Shore A hardness of no more than 45 at room temperature.

4. An ITM according to claim 1, wherein said image transfer layer exhibits a Shore A hardness of between 25 and 35 at room temperature.

5. An ITM according to claim 1, wherein said image transfer layer is comprised of no more than 80% fluoroelastomer.

6. An ITM according to claim 1, wherein said image transfer layer is comprised of no more than 71% fluoroelastomer.

7. An ITM according to claim 1, wherein said image transfer layer is comprised of no more than 65% fluoroelastomer.

8. An ITM according to claim 1, wherein said body and said image transfer layer are in the form of a blanket for attachment to a printing drum.

9. An ITM according to claim 8, further comprising a fixture operative to attach said blanket to a drum.

10. An ITM according to claim 1, wherein said image transfer layer is conductive.

11. An ITM according to claim 1, further comprising a hard under layer.

12. An intermediate transfer member (ITM) for use in electrostatic printing, comprising:

a body portion; and, an image transfer layer comprising a non-silicone fluoroelastomer, wherein said image transfer layer exhibits an RMS surface roughness of no more than 700 Å.

13. An ITM according to claim 12, wherein said image transfer layer exhibits an RMS surface roughness of no more than 500 Å.

14. An ITM according to claim 12, wherein said image transfer layer exhibits an RMS surface roughness of no more than 150 Å.

15. An ITM according to claim 12, wherein said image transfer layer exhibits an RMS surface roughness of between 40-50 Å.

16. A method of printing, comprising:

forming a liquid toner image comprising a pigment toner and a hydrocarbon liquid on an image surface;

first transferring said image to an intermediate transfer member, wherein said intermediate transfer member comprises a release layer comprising a non-silicone fluoroelastomer, wherein the fluoroelastomer comprises a copolymer of TEE/Propylene and ethylene/TFE/PMVE;

then transferring of said image from said intermediate transfer member to a final substrate; and, affixing said image on said final substrate.

17. A method according to claim 16, further comprising heating said intermediate transfer member prior to transferring said image thereto.

18. A method according to claim 17, wherein said heating is to a range between 85° C. and 200° C.

19. A method according to claim 18, wherein said fluoroelastomer based image transfer layer absorbs no more than 10% of said carrier liquid.

20. A method according to claim 18, wherein said fluoroelastomer based image transfer layer absorbs no more than 7.5% of said carrier liquid.

21. A method according to claim 18, wherein said fluoroelastomer based image transfer layer absorbs no more than 3.5% of said carrier liquid.

22. A method according to claim 16, wherein said image surface is a photoreceptor.

23. A method of printing, comprising:

forming a liquid toner image comprising pigmented polymer toner particles and a hydrocarbon liquid on an image surface;

first transferring said image to an intermediate transfer member, wherein said intermediate transfer member comprises a release layer comprising a fluoroelastomer comprising a copolymer of TFE/Propylene and ethylene/TFE/PMVE that is capable of absorbing less than 10% of its weight of the hydrocarbon liquid under conditions of said transfer;

then transferring of said image from said intermediate transfer member to a final substrate; and, affixing said image on said final substrate.

24. A method according to claim 23, wherein said image transfer layer is fluoroelastomer based transfer layer.

25. A method according to claim 23, further comprising heating said intermediate transfer member.

26. A method according to claim 25, wherein said heating is to a range between 85° C. and 200° C.

27. A method according to claim 26 absorbs no more than 7.5% of said carrier liquid.

28. A method according to claim 26, wherein said fluoroelastomer based image transfer layer absorbs no more than 3.5% of said carrier liquid.

* * * * *

UNITED STATES PATENT AND TRADEMARK OFFICE

CERTIFICATE OF CORRECTION

PATENT NO. : 7,302,216 B2
APPLICATION NO. : 11/184440
DATED : November 27, 2007
INVENTOR(S) : Shai Lior et al.

It is certified that error appears in the above-identified patent and that said Letters Patent is hereby corrected as shown below:

In column 12, line 12, in Claim 16, after "copolymer of" delete "TEE" and insert -- TFE --, therefor.

Signed and Sealed this

Fifth Day of August, 2008

JON W. DUDAS
*Director of the United States Patent and Trademark Office*